United States Patent [19]

Smolik

[11] Patent Number: 4,854,096

[45] **Date of Patent: * Aug. 8, 1989**

[54] WALL ASSEMBLY

[76] Inventor: Robert A. Smolik, 670 W. Seventh St., St. Paul, Minn. 55102

[ * ] Notice: The portion of the term of this patent subsequent to Feb. 21, 2006 has been disclaimed.

[21] Appl. No.: 135,991

[22] Filed: Dec. 21, 1987

Related U.S. Application Data

[63] Continuation of Ser. No. 851,087, Apr. 14, 1986, abandoned, which is a continuation-in-part of Ser. No. 542,526, Oct. 17, 1983, abandoned.

[51] Int. Cl.[4] ..... E04C 3/04

[52] U.S. Cl. ..... 52/241; 52/732; 52/735

[58] Field of Search ..... 52/241, 242, 243, 666, 52/732, 735, 729, 483

[56] References Cited

U.S. PATENT DOCUMENTS

| | | | |
|---|---|---|---|
| 2,088,781 | 8/1937 | Folsom | 52/290 |
| 2,105,771 | 1/1938 | Holdsworth | 52/241 |
| 2,275,109 | 3/1942 | McGee . | |
| 2,315,687 | 4/1943 | Burke . | |
| 2,796,158 | 6/1957 | Miles et al. . | |
| 3,101,817 | 8/1963 | Radek . | |
| 3,332,188 | 7/1967 | Schaefer . | |
| 3,388,521 | 6/1968 | Tillisch et al. . | |
| 3,423,893 | 1/1969 | Hyatt . | |
| 3,423,896 | 1/1969 | Widerby | 52/241 |
| 3,492,766 | 2/1970 | Andrews . | |
| 3,536,345 | 10/1970 | Leifer . | |
| 3,680,271 | 8/1972 | Satchell | 52/656 |
| 3,759,001 | 9/1973 | Judkins et al. . | |
| 3,845,601 | 11/1974 | Kostecky | 52/290 |
| 3,989,399 | 11/1976 | Slowbe | 403/245 |
| 4,185,422 | 1/1980 | Radek . | |

FOREIGN PATENT DOCUMENTS 587047 4/1947 United Kingdom .

OTHER PUBLICATIONS

U.S. Gypsum, Red Book of Lathing & Plastering, 1967, pp. 74, 75, 110, 120.

United States Gypsum 1983 catalog, Steel Framing Components & Accessories for Drywall, Plaster and Load Bearing Construction, pp. 1-3 and 6.

*Primary Examiner*—David A. Scherbel

*Assistant Examiner*—Caroline D. Dennison

*Attorney, Agent, or Firm*—Burd, Bartz & Gutenkauf

[57] ABSTRACT

A wall assembly comprising a plurality of generally upright wall studs in assembled relationship to lower and upper generally horizontal support beams. The wall studs can be of the metal variety and have a generally C-shaped profile with a channel located opposite a major side member of the wall stud. The support beams are channel-shaped and have parallel spaced-apart flanges extended inwardly from side walls forming a channel. The flanges have pairs of opposing notches which form pockets having a profile corresponding partially to the profile of the upright wall stud whereby the wall stud is insertable in the channel of the support beam and can be twisted to an extent where the wall stud snaps into place with respect to the pocket formed by a pair of notches with the cross-sectional length of the wall stud in transverse alignment with the longitudinal axis of the support beam. Wallboard is installed on the framework to complete the wall structure.

19 Claims, 2 Drawing Sheets

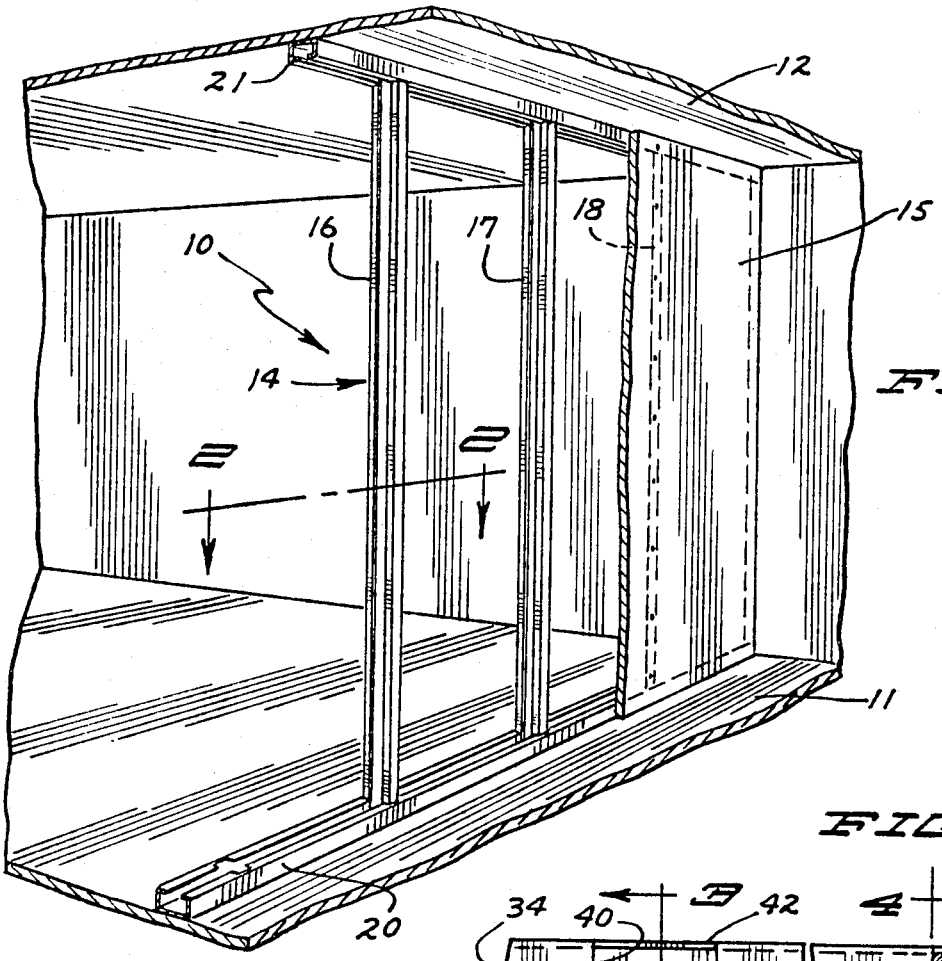
FIG. 1
FIG. 2
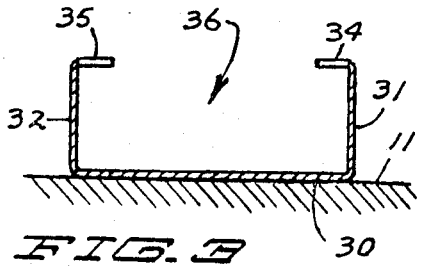
FIG. 3
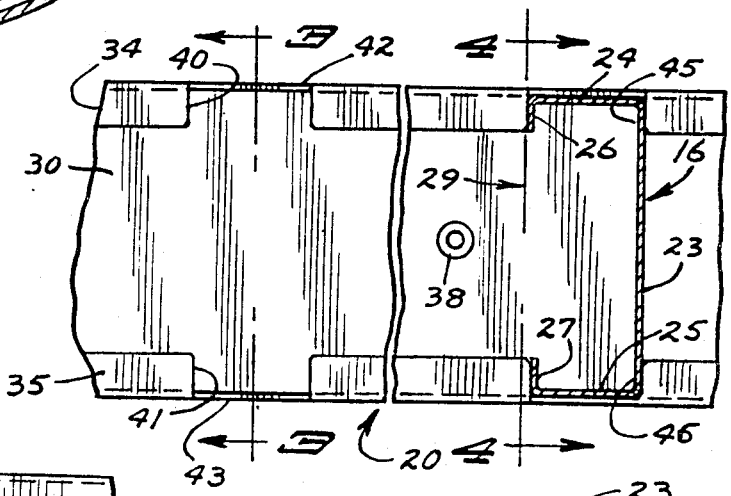
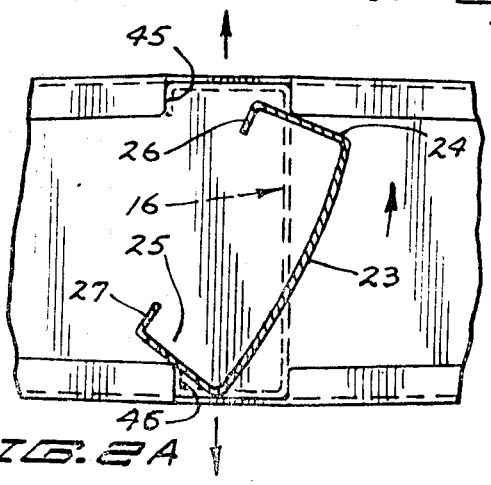
FIG. 2A
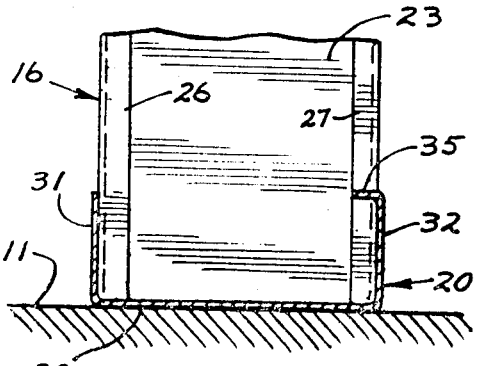
FIG. 4

WALL ASSEMBLY

CROSS REFERENCE TO RELATED APPLICATIONS

This application is a continuation of U.S. application Ser. No. 851,087, filed Apr. 14, 1986, titled WALL ASSEMBLY which is a continuation in part of U.S. application Ser. No. 542,526, filed Oct. 17, 1983 titled WALL ASSEMBLY, both now abandoned.

BACKGROUND OF THE INVENTION

In the construction of commercial and residential buildings, the cost of labor is a significant cost factor and, accordingly, the speed with which the construction worker proceeds is significant. While building materials and tools that increase the efficient use of time of the construction worker are desirable, the structural integrity of the construction must not be compromised.

Interior wall construction with the use of vertical metal wall studs and horizontal metal channel-shaped runners is common. The runners and studs are assembled into a frame structure that is secured to floors and ceilings, and the frame structure is covered with drywall construction panels or the like to form a wall surface. Assembly of the frame structure can be tedious. According to one method, narrow slots are formed at the upper and lower ends of the metal wall stud. The side walls of the channel-shaped runners are fitted in the slots and metal screws are used to fix adjacent portions of the side walls and metal wall studs. The resultant wall assembly is satisfactory structurally but, nonetheless, slow in construction. The upper and lower ends of the wall studs are fixed to the runners. This can be problematic upon thermal expansion and contraction of building walls.

SUMMARY OF THE INVENTION

The invention pertains to wall assembly construction wherein vertical metal wall studs are assembled to horizontal channel-shaped members or beams to form a framework for mounting drywall construction panels in formation of a wall. Lower and upper channel-shaped support members or beams are fastened in parallel relationship, respectively, to the floor and ceiling of a building at the intended wall site. Each support beam has flat base for attachment to ceiling or floor structure and parallel sides perpendicular to the base for forming a channel. Retaining members extend from the sides inward of the channel parallel to the base. The retaining members form pockets regularly spaced apart along the length of the beam to retain end portions of the wall studs at predetermined accurately measured intervals. In one embodiment, the retaining members are comprised as flanges extending inwardly from upper edges of the side walls of the support beam. Each pocket is formed by a first notch on one of the flanges and a second notch on the opposite flange in facing relationship to the first notch. In another embodiment, the restraining members are comprised as punched-out side wall portions forming fingers which extend into the channel and define the pockets to hold the stud ends.

The metal upright wall studs are of the thin-walled, C-shaped variety having a major side member and perpendicular end members. Inwardly turned lips are formed on the end members parallel to and opposite the major side member. The wall stud is resilient about its longitudinal axis permitting cross-sectional deflection.

The mounting beams are secured respectively to the floor and ceiling with vertically aligned pockets forming mounting openings for receipt of ends of the wall studs. In assembly of a wall stud to the mounting beams, upper and lower ends of the wall stud are inserted diagonally in the channel opening of the mounting beams. Diagonal corners of the wall stud are inserted in a pocket. The wall stud is then twisted about its longitudinal axis causing diagonal deflection of the wall stud and some corresponding deflection of the side walls of the mounting beams as the wall stud snaps into place with respect to the pocket. Upon being snapped into place, the wall stud occupies the space or pocket defined by the retaining members to securely mount the wall stud with respect to the upper and lower support beams preparatory to mounting drywall construction panel.

IN THE DRAWINGS

FIG. 1 is a fragmentary perspective view of a wall assembly section according to the present invention with portions removed for purposes of illustration;

FIG. 2 is an enlarged sectional view of a portion of the wall assembly of FIG. 1 taken along the line 2—2 thereof;

FIG. 2A is a view similar to a portion of FIG. 2 showing the procedure of assembling a metal wall stud to a support beam, the metal wall stud shown in full lines in the process of being inserted with respect to the beam and in broken lines as inserted with respect to the support beam;

FIG. 3 is a sectional view of a portion of the mounting beam shown in FIG. 2 taken along the line 3—3 thereof;

FIG. 4 is a sectional view of a portion of the wall assembly of FIG. 2 taken along the line 4—4 thereof;

DESCRIPTION OF PREFERRED EMBODIMENTS

Figure 5:
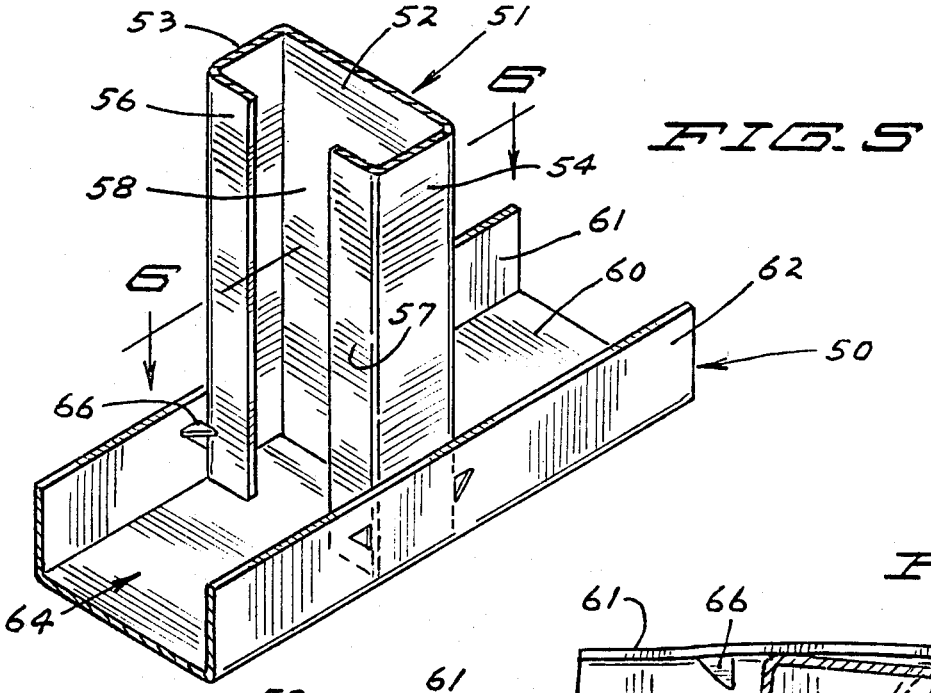
FIG. 5 is a perspective view of a wall std and support beam according to a second form of the invention.

Referring to the drawings, there is shown in FIG. 1 a wall assembly section according to one form of the invention indicated generally at 10 installed with respect to a floor 11 providing a lower support surface, and a ceiling 12 which provides an upper support surface. Wall section 10 is installed on a story of a building, spanning the distance between the floor and ceiling which, in typical modern commercial construction, will be comprised of concrete or similar fireproof material. Wall section 10 includes a wall framework 14 to be covered on one or both sides by drywall paneling or the like, partially shown at 15. Wall section 10 is quickly and easily erected for effecient use of the construction worker's time without compromising the structural integrity of the resultant wall structure.

Framework 14 is shown to include a plurality of upright or generally vertical metal wall studs 16, 17, 18 having lower and upper ends in assembled relationship, respectively, to a lower channel-shaped support beam 20 and an upper channel-shaped support beam 21. Each wall stud has a longitudinal axis corresponding to its height. The wall studs are of the C-shaped variety being generally rectangular in cross-sectional profile. As shown in FIG. 2, wall stud 16 is thin-walled and includes a major side member 23 and first and second end members 24, 25 disposed in perpendicular relationship to the major side member 23. First and second lips 26, 27 extend inwardly from the opposite edges of end members 24, 25 in parallel relationship to major side member 23 terminating a short distance inwardly defining an opening 29. Stud 16 is typically formed of steel providing a strong compression member that is flexible and deflectable in twisting about its longitudinal axis by virtue of opening 29. Such steel stud members are sometimes formed with one end member slightly shorter than the opposite one for purposes of nesting a pair of studs together to form a single box-like beam, the second end member 25 being shown slightly shorter than the first end member 24 in FIG. 2.

Lower and upper channel support beams 20, 21 are alike in construction. Lower support beam 20 has a base wall 30 horizontally disposed in the configuration shown and first and second parallel side walls 31, 32 perpendicular to and extending upwardly from the side edges of base wall 30 forming a channel 36. First and second segmented longitudinal horizontal flanges 34, 35 extend inwardly of channel 36, respectively, from the upper edges of opposite longitudinal side walls 31, 32 generally parallel to the base wall 30. Base wall 30 is secured or anchored to floor 11 by suitable means, such as concrete nails 38.

Longitudinal flanges 34, 35 are segmented by pairs of opposed spaces or notches forming pockets or seats for insertion and retention of the lower end portions of the upright wall studs. The pockets are preferably located at regularly spaced premeasured intervals along the length of support beam 20. As shown in FIG. 2, a first pair of notches includes a first notch 40 formed in the first flange 34 and a second notch 41 formed in the second flange 35 in opposed, facing relationship to the first notch 40. First notch 40 comprises an interruption or cut-out portion of flange 34 extended outwardly to a side wall section 42 of first side wall 31. Second notch 41 is comprised as an interruption or cut-out portion of the second flange 35 bounded by the edges of flange 35 segments and a section 43 of the second wall 32. Support beam 20 is formed of a resiliently deflectable sheet material, such as steel, whereby a certain measure of deflection can occur in the vicinity of the side wall sections 42, 43 of notches 40,41. The notches 40, 41 are in opposed relationship and define a seat corresponding in shape to the rectangular cross-sectional profile of a metal wall stud. FIG. 2 also shows a second seat comprised of a second pair of opposed notches formed in first and second flanges 34, 35 including a first notch 45 and a second notch 46 identical in configuration to the notches 40, 41 of the first pair. The lower end of a metal wall stud 16 is shown installed in the seat formed by the notches 45, 46 and flanges 34, 35. Wall stud 16 has a cross-sectional length defined by the outside distance between first and second end members 24, 25. Wall stud 16 has a cross-sectional width defined by the outside distance between the major side member 23 and the lips 26, 27. The inside distance between the side walls 31, 32 of support member 20 corresponds to the cross-sectional length of metal wall stud 16, such that the metal wall stud 16 spans the interior distance between the side walls. The length of the spaces 45, 46 corresponds to the cross-sectional width of metal wall stud 16. The flanges 34, 35 extend inwardly of the channel 36 a distance sufficient to retain the wall stud end portion. In the instance where one end member 25 of metal wall stud 16 is shorter than the opposite end member 24, one notch 46 can be correspondingly shorter than the other notch 45 to provide a close accommodation. This can be seen in FIG. 4. The notches 45, 46 partially define a portion of the rectangular cross-sectional profile of wall stud 16 corresponding to the portions adjacent end members 24, 25. In such configuration, the lower end of metal wall stud 16 is securely positioned in the seat formed by notches 45, 46.

Upper support beam 21 is identical in configuration to lower support beam 20 and is fastened to ceiling 12 parallel to lower support beam 20 with pairs of notches forming seats or pockets vertically aligned with seats formed in the lower support beam 20. In the vertical wall assembly of FIG. 1, the vertical wall studs 16, 17, 18 each have a lower end installed in a seat formed by opposed notches in the lower support beam 20, with upper ends installed in seats formed of corresponding opposing pairs of notches in upper support beam 21. As so installed, the vertical wall studs are secure permitting installation of drywall panel 15 thereon in conventional fashion after installation of various wiring and receptacles in the usual fashion (not shown). The vertical wall studs are installed at predetermined locations along the support beams eliminating the need for tedious measurement.

The dimensional relationship between the cross-sectional profile of the wall stud and the support beam seat is such that erection of the framework 14 is quickly and easily accomplished by the construction person. Support beams 20, 21 are installed on the floor and ceiling at the intended wall site with vertically aligned pairs of opposed notches. Support beams 20, 21 can be positioned to accurately and symmetrically locate upright wall studs between other walls or a wall and a door or the like. The upper and lower ends of a wall stud are positioned in the channels of the upper and lower support beams with the cross-sectional length of the wall stud diagonally orientated with respect to the corresponding channel of the support beam. For example, as shown in FIG. 2A, wall stud 16 is positioned in the channel 36 of lower support beam 20 with the cross-sectional length somewhat diagonally orientated and restrained from further movement by diagonally opposed flanges. The corner formed between major side member 2 and second end member 25 is positioned in the second notch 46. The opposite end wall 24 is in contact with the first flange 34 proximate the first notch 45. The upper end of metal wall stud 16 is correspondingly positioned with respect to upper support beam 21. From this configuration, the wall stud is manually twisted. The twisting action manually results in inward deflection of the end members of wall stud 16 or a contraction of the major cross-sectional dimensions thereof. There is some amount of corresponding outward deflections of the side walls 31, 32 of support beam 20. Further twisting of the wall stud in the direction indicated by the arrow in FIG. 2A results in the wall stud snapping into place with respect to the seat formed by first and second notches 45, 46, as shown in broken lines in FIG. 2A. The cross-sectional dimension of the wall stud deflects an amount corresponding to the distance the flanges 34 and 35 project into channel 36 in order to clear them upon being snapped into place. The cross-sectional length of wall stud 16 is in transverse alignment with the longitudinal axis of support beam 20. The wall stud is then securely positioned with respect to the pocket formed by first and second notches 45, 46 and thus lower support beam 20. The procedure is accomplished quickly, and the remainder of the wall construction proceeds as earlier described. The wall studs are securely fastened to the support beams but are vertically movable. Upon thermal expansion of a room or wall, the vertical wall stud can move somewhat, avoiding damage that might otherwise occur.

Referring to FIGS. 5 through 8, there is shown a wall construction stud and support beam connection according to another form of the invention. A lower horizontal channel-shaped support beam 50 and a corresponding upper beam (nto shown) retain an upright C-shaped metal type thin-walled wall stud 51 having a major side member 52 connected to first and second end members 53, 54. First and second lips 56, 57 extend inward from opposite edges of the end members in parallel relationship to the major side member 52 terminating a short distance inwardly and defining an opening 58 between them. Wall stud 51 has a cross-sectional length defined by the outside distance between the end membes 53, 54 and a cross-sectional width defined by the outside dimension between the lips 56, 57 and the major side member 52. Wall stud 51 and support beam 50 are formed of resilient material, such as sheet metal, which permits a limited amount of deflection under manual force.

Lower support beam 50 has a base wall 60 and first and second parallel side walls 61, 62, which form a channel 64 corresponding to the cross-sectional width of the wall stud 51. The lower and upper support beams are spaced apart a vertical distance which corresponds to the length of the wall stud or the height of the room in which the wall is to be installed.

Figure 8:
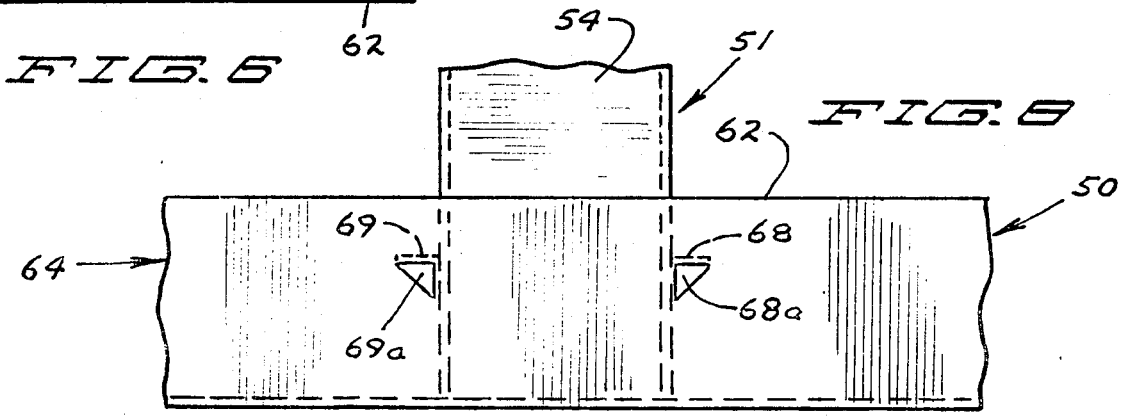
FIG. 8 is an enlarged side elevational view of the wall stud and support beam assembly of FIG. 5.

A mounting pocket or seat is formed for retention of the lower end portion of stud 51 by a plurality or a set of inwardly projecting retaining members or retaining fingers 66-69. A first pair of retaining fingers 66, 67 extend inwardly of channel 64 from the side wall 61 of support beam 50 and are spaced apart on the side wall a distance corresponding to the cross-sectional width of the wall stud 51. A second pair of fingers 68, 69 extend inwardly in symmetrical relationship from the second side wall 62 in facing relationship to the first pair of retaining fingers and are spaced apart on the side wall 62 a distance corresponding to the cross-sectional width of the stud 51. The retaining fingers 66-69 are located intermediate or approximately midway between the top and bottom edges of the side walls 61, 62 of support beam 50. The set of retaining fingers 66-69 define a rectangular pattern corresponding to the undeflected cross-sectional shape of the wall stud 51. In the configuration shown, the retaining fingers are right triangularly shaped with legs facing inward of the retaining pocket and with hypotenuses facing outward. The retaining fingers are conveniently formed by punched-out portions of the side walls of the support beam 50. As shown in FIG. 8, spaces or openings 68A and 69A are present as a result of a punching procedure forming the pair of retaining fingers 68, 69. In practice, sets of retaining fingers are spaced along the length of support beam 50 at regular intervals for mounting of wall studs at necessary or desired locations eliminating the necessity of making individual measurements.

Figure 6:
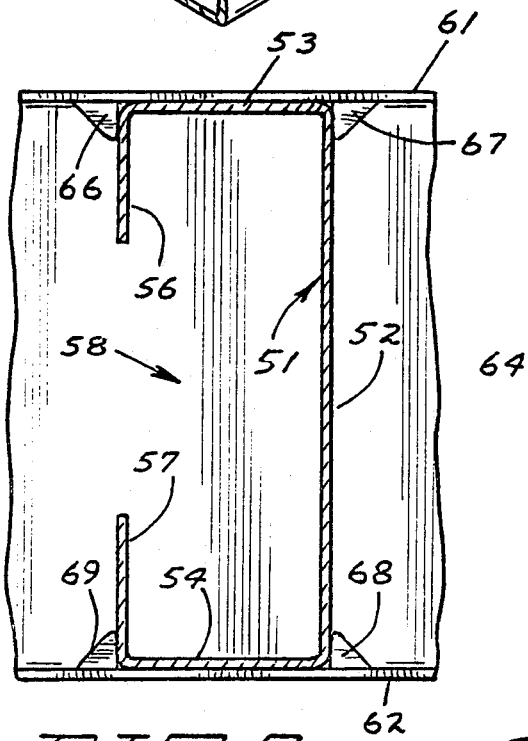
FIG. 6 is an enlarged view partly in section of the wall stud and support beam of FIG. 5 taken along the line 6—6 thereof.
Figure 7:
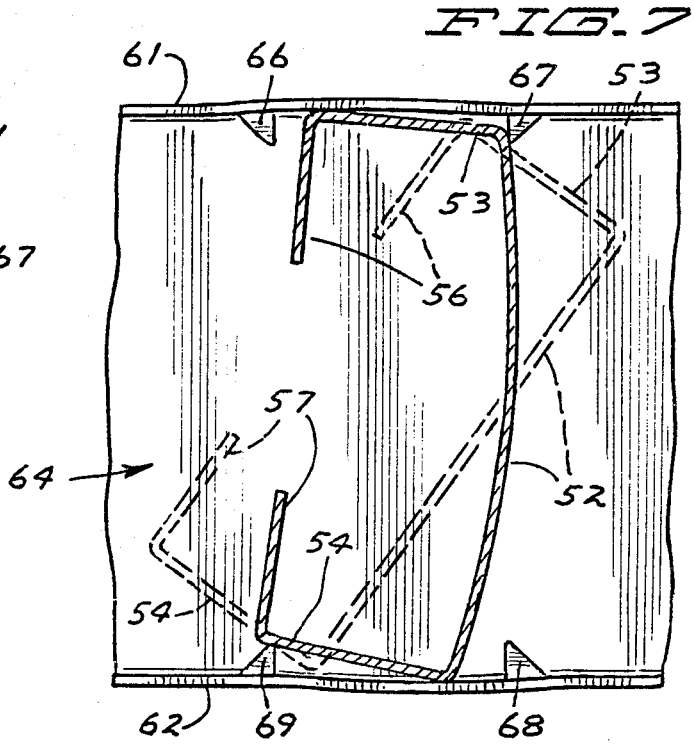
FIG. 7 is a view like that of FIG. 6 illustrating the procedure of assembly of the wall stud to the support beam.

The retaining fingers 66-69 extend inward of the channel 64 a distance sufficient to hold the base portion of wall stud 51 in place, yet leave a restriction of sufficient dimension or breadth to permit passage of the wall stud under cross-sectional deflection upon assembly of the wall stud to the support beam. Assembly procedure of the wall stud to this support beam is like that earlier described with respect to the configurations shown in FIGS. 1–4. As shown in FIG. 7, assembly of the wall stud is accomplished by positioning the end portion of the wall stud diagonally in the channel 64 with diagonal corners of the wall stud located between the restraining fingers, and the opposite diagonal pair of corners located outward of the seat defined by the retaining fingers, as shown in phantom in FIG. 7. The opposite end of the wall stud is similarly situated in the opposite support beam (not shown). The beam is manually twisted in a direction to insert or snap it into the pocket or in a counterclockwise direction, as viewed in FIG. 7. Upon twisting action, the cross section of the beam deflects inwardly with a corresponding deflection of the diagonal dimension, as shown in full lines in FIG. 7. As the cross section of the wall stud deflects inwardly, the side walls can also deflect outwardly to an extent permitting passage of the cross section of the wall stud between diagonally opposed retaining fingers to a position with the wall stud cross section occupying the retaining seat. The diagonal dimension of the wall stud is contracted to an extent that it fits between diagonally opposed retaining fingers whereupon the wall stud is snapped into place, as is shown in FIG. 6, resuming a normal cross-sectional configuration. The dimension between diagonally opposed retaining fingers is sufficient to permit passage of the cross section of the beam without application of undue twisting force of force sufficient to cause permanent deformation of either the wall stud or the support beam.

Upon assembly of the several wall studs to the support beams, the wall is erected as earlier described by placement of appropriate wallboard or the like, and the wall construction is completed. The ease of assembly of the wall studs to the support beams results in a reduced expenditure of time in constructing the wall, and the wall studs are accurately and securely positioned.

While there has been shown and described certain preferred embodiments of the invention, it will be apparent that certain deviations can be had without departing from the scope and spirit of the invention.

The embodiments of the invention in which an exclusive property or privilege is claimed are defined as follows:

1. A wall assembly comprising:

a framework formed of a plurality of longitudinal wall studs of the type formed of resiliently deflectable material having a generally C-shaped cross-sectional profile with a major side member, first and second end members disposed in generally perpendicular relationship to the major side member, first and second lips extended inward a short distance from opposite edges of the end members parallel to the major side member, each stud having a cross-sectional length of the outside distance between the end members and a cross-sectional width of the outside distance between the major side member and the lips;

a first support beam having a longitudinal axis and formed of a resiliently deflectable material, said beam having a base wall, first and second side walls extended perpendicularly from the base wall forming a channel having a width generally corresponding to the cross-sectional length of the wall studs;

said support beam having a plurality of pockets for retention of longitudinal ends of the wall studs disposed generally perpendicular to the support beam, said pockets corresponding generally in shape to the cross-sectional shape of the wall studs with the cross-sectional length of the wall stud oriented perpendicular to the longitudinal axis of the beam;

said plurality of wall studs assembled to the support beam each with a longitudinal end installed in one of said pockets;

boundaries of each of said pockets formed by first, second, third and fourth flat, cantilever retaining members including first and second co-planar retaining members having edges with facing edges spaced apart on the first side wall a distance generally corresponding to the cross-sectional width of the wall stud and extending inward of the channel, third and fourth retaining members on the second side wall of the support beam with facing edges spaced apart in symmetrical co-planar relationship to the first and second retaining members and extending inward of the support beam, each said retaining member being formed from a flat multi-sided tabular section cut out of a side wall, said tabular section being bent inwardly of the support beam channel to a position generally perpendicular to the side wall and parallel to the support beam and extending into the channel wherein two of the sides of the multi-sided section form a bending axis and the facing edge of the retaining pocket, said retaining members being spaced apart on the first and second side walls with a distance between diagonally opposed members smaller than an undeflected cross-sectional length of the vertical wall stud and large enough to permit passage of a vertical wall stud from an orientation diagonally disposed with respect to said support beam channel to a position seated in the pocket upon deflection between the support beam side walls and the wall stud when the wall stud is twisted against the retaining members to move it in position into the pocket whereby the size of the retaining members may be selected according to the gauge of the deflectable material.

2. The wall assembly claim 1 including: a second support beam disposed in parallel facing relationship to the first support beam and having a base wall, first and second perpendicular side walls forming a channel, and a plurality of corresponding pockets in alignment with pockets of the first support beams, said vertical wall studs having second longitudinal ends assembled in corresponding pockets of the second support beam.

3. The wall assembly of claim 2 wherein: said wall studs and channel support beams are formed of steel.

4. The wall assembly of claim 2 including: wallboard installed in covering relationship to the wall studs.

5. The wall assembly of claim 1 wherein: said members are right triangularly shaped with legs facing inward of the pocket and hypotenuses facing outward of the pocket.

6. A wall assembly comprising:

a framework formed of a plurality of longitudinal wall studs having a generally C-shaped, cross-sectional profile with a major side member, first and second end members disposed in generally perpendicular relationship to the major side member, first and second lips extended inward a short distance from opposite edges of the end members parallel to the major side member, each stud having a cross-sectional length of the outside distance between the end members and a cross-sectional width of the outside distance between the major side member and the lips;

a first longitudinal support beam having a longitudinal axis, a base wall and first and second side walls extended perpendicularly from the base wall forming a channel having a width corresponding to the cross-sectional length of the wall stud;

said support beam having a plurality of generally rectangular pockets for retention of end portions of the longitudinal wall studs, each pocket having boundaries formed by first, second, third and fourth co-planar tabular retaining members extended inwardly from the support beam side walls into the support beam channel at a location on the side walls intermediate the top and bottom edges of the side walls, including first and second retaining members extended inwardly from the first side wall and spaced apart a distance corresponding to the cross-sectional width of the wall studs, and third and fourth retaining members extended inwardly from the second support beam side wall in symmetrical relationship to the first and second retaining members, each retaining member comprised as a flat, multi-sided section cut out of a side wall, wherein two of the sides of each multi-sided member form a bending axis and a pocket boundary, the section being bent about the bending axis inwardly of the channel to a position substantially perpendicular to the side wall in cantilever fashion and substantially parallel to the base extending into the channel, whereby the size of the members can be selected according to the gauge of the support beam material;

said wall studs positioned with longitudinal ends located in said pockets generally perpendicular to the support beam and the cross-sectional length of the wall studs transversely orientated with respect to the longitudinal axis of the support beam.

7. The wall assembly of claim 6 wherein: retaining members on opposite side walls of the first support beam are spaced apart a distance greater than the cross-sectional width of the wall stud and less than the undeflected cross-sectional length of the wall stud but sufficient to permit passage of the cross-sectional profile of the wall stud from an orientation diagonally disposed with respect to said support beam channel to a position seated in the pocket upon deflection between the support beam side walls and the wall stud cross-sectional profile when the support beam is twisted against the retaining members to move it into position seated in the pocket.

8. The wall assembly of claim 7 including: a second support beam disposed in parallel facing relationship to the first support beam and having a base wall, first and second side walls forming a channel, and a plurality of pockets corresponding to and in alignment with pockets of the first support beam, said vertical wall studs having second longitudinal end portions located in the pockets of the second support beam.

9. The wall assembly of claim 8 wherein: said retaining members are triangular in shape.

10. The wall assembly of claim 8 wherein: said retaining members are right triangular in shape with legs facing inward of the pocket and hypotenuses facing outward of the pocket.

11. The wall assembly of claim 8 including: wallboard installed with respect to the vertical wall studs.

12. The wall assembly of claim 6 wherein: said pockets of the support beam are regularly spaced apart at premeasured intervals.

13. The wall assembly of claim 6 including: a second support beam disposed in parallel facing relationship to the first support beam and having a base wall, first and second side walls forming a channel, and a plurality of pockets corresponding to and in alignment with pockets of the first support beam, said vertical wall studs having second longitudinal end portions located in the pockets of the second support beam.

14. A support beam for use with elongate longitudinal C-shaped wall studs having a web and two flanges in wall construction, comprising:

a longitudinal base;

first and second side walls each connected at a bottom edge to the base and extending perpendicularly from the base to a top edge, said side walls spaced apart a distance forming a channel having a width corresponding to a web of a longitudinal wall stud;

a plurality of pockets formed in said channel for receipt of end portions of longitudinal wall studs, each pocket formed of a set of tabular retaining fingers extended inwardly of the support beam side walls into the support beam channel at a location on the side wall intermediate the top and bottom edges of the side walls, including first and second retaining fingers extended inwardly from the first side wall and spaced apart a distance corresponding to a flange of the wall studs, and third and fourth retaining fingers extended inwardly from the second support beam side wall in symmetrical relation to the first and second retaining fingers to define said pocket;

each said retaining finger comprised as a flat, multi-sided section cut out of a side wall, wherein two of the sides of the multi-sided section form a bending axis and a pocket boundary the section being bent about the bending inwardly of the channel to a position in cantilever relationship to the side wall and parallel to the base, whereby the size of the finger can be selected according to the gauge of the support beam.

15. The support beam of claim 14 wherein: the pockets are regularly spaced apart at premeasured intervals along the length of the side walls.

16. The support beam of claim 14 wherein: said retaining fingers are triangular in shape.

17. The support beam of claim 14 wherein: said retaining fingers are right triangular in shape with legs facing inward of the pocket and hypotenuses facing outward of the pocket.

18. The support beam of claim 14 wherein said wall studs have deflectable characteristics and wherein: the cross section of the wall stud and the spacing between retaining fingers on opposite side walls are dimensionally related to permit the undeflected wall stud end portion to be positioned diagonally in the channel in opposed relation to said retaining fingers, and to be moved into place in the pocket upon being twisted in a direction toward being seated in the pocket and causing sufficient deflection between the wall stud cross-sectional profile and the side walls to permit passage of the wall stud to a position of seated relationship in the pocket.

19. The support beam of claim 14 wherein: the retaining fingers on opposite side walls are spaced apart a distance greater than a cross-sectional width of the wall stud and less than an undeflected cross-sectional length of the wall stud but sufficient to permit passage of the cross-sectional profile of the wall stud from an orientation diagonally disposed with respect to said support beam channel to a position seated in the pocket upon deflection between the support beam side walls and the wall stud cross-sectional profile when the support beam is twisted against the retaining fingers to move it into position seated in the pocket.

* * * * *